US006044522A

United States Patent [19]

Liu

[11] Patent Number: 6,044,522

[45] Date of Patent: Apr. 4, 2000

[54] HIDDEN HANDLE DEVICE OF A TRUNK

[76] Inventor: Chin-Shung Liu, 2F, No. 6, Lane 75, Sec. 4, MinSheng E. Road, Taipei City, Taiwan

[21] Appl. No.: 09/195,321

[22] Filed: Nov. 18, 1998

[51] Int. Cl.[7] ..... A47B 95/02

[52] U.S. Cl. ..... 16/113.1; 280/655; 280/655.1

[58] Field of Search ..... 16/113.1, 405, 16/429; 280/655, 655.1, 47.29, 47.315, 47.371; 190/115, 117, 118, 18 A

[56] References Cited

U.S. PATENT DOCUMENTS

| | | | |
|---|---|---|---|
| 5,624,012 | 4/1997 | Wang | 16/113.1 |
| 5,692,266 | 12/1997 | Tsai | 16/113.1 |
| 5,803,214 | 9/1998 | Wang | 16/405 |
| 5,884,362 | 3/1999 | Tsai | 16/113.1 |

FOREIGN PATENT DOCUMENTS

| | | | |
|---|---|---|---|
| 86213725 | 7/1997 | Taiwan | A45C 5/14 |

*Primary Examiner*—Chuck Y. Mah
*Attorney, Agent, or Firm*—Ostrolenk, Faber, Gerb & Soffen, LLP

[57] ABSTRACT

A hidden handle device of a trunk is disclosed. Two inner tubes are inserted into the outer tubes fixed on the trunk. A handle is installed on the upper end of the inner tubes and an inner rim is formed between the handle and the inner tube. By a button, a pillar on the side wall of the inner tube can be controlled to telescopically move in order to determine whether it is buckled on the hole formed on the outer tube. A fixing seat with a concave portion is installed on the upper ends of the outer tubes. The opposite two sides of the concave portion are installed with respective through holes and each of the through holes is installed with respective containing chamber. Elastic elements and ejecting elements are sequentially arranged win the containing chambers. Thereby, when the handle is pushed downwards so that the handle is received with the concave portion of the fixing seat, and the aforementioned pillars is buckled in the holes of the outer tubes, the ejecting elements will press the elastic elements. When the button is pushed so that the pillar is released from the hole, then by the elastic elements applying an elastic force on the ejecting elements, the handle will resile upwards, therefore, the inner tube will be easily pulled out.

2 Claims, 4 Drawing Sheets

HIDDEN HANDLE DEVICE OF A TRUNK

FIELD OF THE INVENTION

The present invention relates to a hidden handle device of a trunk, and especially to a handle device, in which when the length of the outer tubes within a trunk is prolonged with the size of the trunk, the inner tubes inserted within the outer tubes can be still retained with a predetermined length so that the user can pull out the inner tubes conveniently.

BACKGROUND OF THE INVENTION

Since the travel to foreign nations has become a more and more popular action recently, a trunk which can be portable by drawing is preferable by travelers. In general, a drawing type trunk is installed with roll wheels on the lower end thereof, while one side of the trunk is fixed with outer tubes. Inner tubes are inserted into the outer tubes. A handle is arranged on the upper end of the inner tubes. A telescopic pillars are installed on the side walls near the lower end of the inner tubes, and a plurality of holes for being penetrated by the pillars are arranged on the side walls of the outer tubes. The button are installed on the handle. When the button is pushed, by a driving means disposed between a pillar installed within the inner tubes and a button, the telescopic movement of the pillar is controlled so that no matter the inner tubes are received completely or are not received within the outer tubes, they can be fixed by buckling the pillar into the holes in different positions so that as the inner tubes are pulled from the outer tubes, the user can hold the handle to draw the trunk. In the conventional draw-able trunk, when the inner tubes are completely received within the outer tubes, the handle is still projected above the trunk. In consideration of the appearance, in an improvement design, a fixing seat is installed on the upper end of the outer tubes and a concave portion is installed above the fixing seat. Thereby, as the inner tubes are completely received within the outer tubes, the handle is still received within the concave portion. In order that the handle within the trunk can be convenient drawn out, Taiwan Patent Publication No. 86213725 (hereinafter it is call as "prior Patent") discloses a structure, in which a spring is installed within the outer tubes so that after the inner tubes is completely received within the outer tubes, the lower portions of the inner tubes can compress the spring so that an internal energy is stored within the spring. While as a button on the handle is pressed so that the inner tubes are released from the outer tubes, the inner tube will be ejected upwards, further the handle also ejected upwards from the concave portion so that the user's hand can hold the handle to draw out the inner tubes.

In the prior patent, although a structure with a hidden handle which can be pulled conveniently for holding by hand is disclosed, the length of the inner tubes must be long enough for compressing the spring after it is received within the outer tubes. Thus, if the size of the trunk is large enough and length thereof is longer, the length of the outer tubes must be prolonged to match the size of the trunk and also the length of the inner tubes are also necessarily prolonged. Therefore, after the inner tubes are drawn out completely, the length thereof will be too long to feel comfortable. In consequence, the user must inconveniently apply a large force to draw the trunk. Therefore, it is desired to have a brand new design by which the defect inducing from the handle to be ejected from the fixing seat is improved.

SUMMARY OF THE INVENTION

Accordingly, the primary object of the present invention is to provide a hidden handle device of a trunk. Two elastic elements are installed on a fixing seat on the upper ends of the outer tubes. By the elastic force of the elastic element, the ejecting elements can contact with the inner rim of a handle. Thus, by the elastic force of the elastic element, the handle can directly eject upwards so as to separate with the concave portion installed on the fixing seat. Thus, the inner tubes can be retained in the original length irrespective of the length of the outer tubes. Thus, the inner tubes can be pull out within the range matching with the comfortable requirement of ergonomics. Therefore, the user is more convenient and comfortable.

Accordingly, in the hidden handle device of a trunk, two inner tubes are inserted into the outer tubes fixed on the trunk. A handle is installed on the upper end of the inner tubes and inner rims are formed between the handle and the inner tubes. By a button, a pillar on the side wall of the inner tube can be controlled to telescopically move in order to determine whether it is buckled on one hole formed on the outer tube. A fixing seat with a concave portion is installed on the upper ends of the outer tubes. The opposite two sides of the concave portion are installed with respective through holes and each of the through holes is installed with respective containing chamber. An elastic element and an ejecting element are sequentially arranged within the containing chamber. Thereby, when the handle is pushed downwards so that the handle is received with the concave portion of the fixing seat, and the aforementioned pillars is buckled in the holes of the outer tubes, the ejecting elements will press the elastic elements. When the button is pushed so that the pillar is released from the hole, then by the elastic elements applying an elastic force on the ejecting elements, the handle will resile upwards, therefore, the inner tube will be easily pulled out.

The various objects and advantages of the present invention will be more readily understood from the following detailed description when read in conjunction with the appended drawing.

DETAILED DESCRIPTION OF THE PREFERRED EMBODIMENTS

Figure 1:
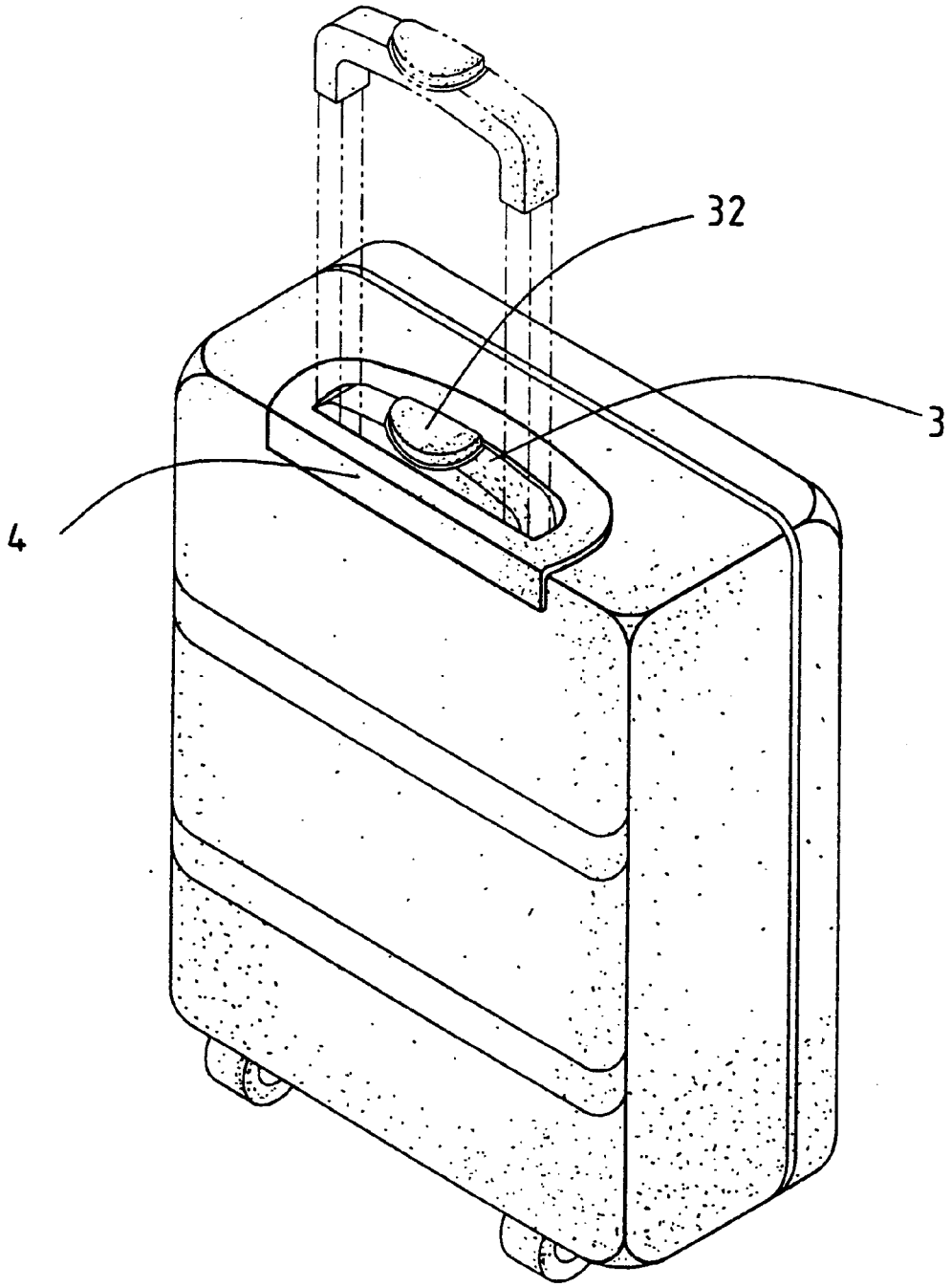
FIG. 1 is a perspective view of an embodiment showing the handle of the present invention is telescopically moving with a trunk.
Figure 2:
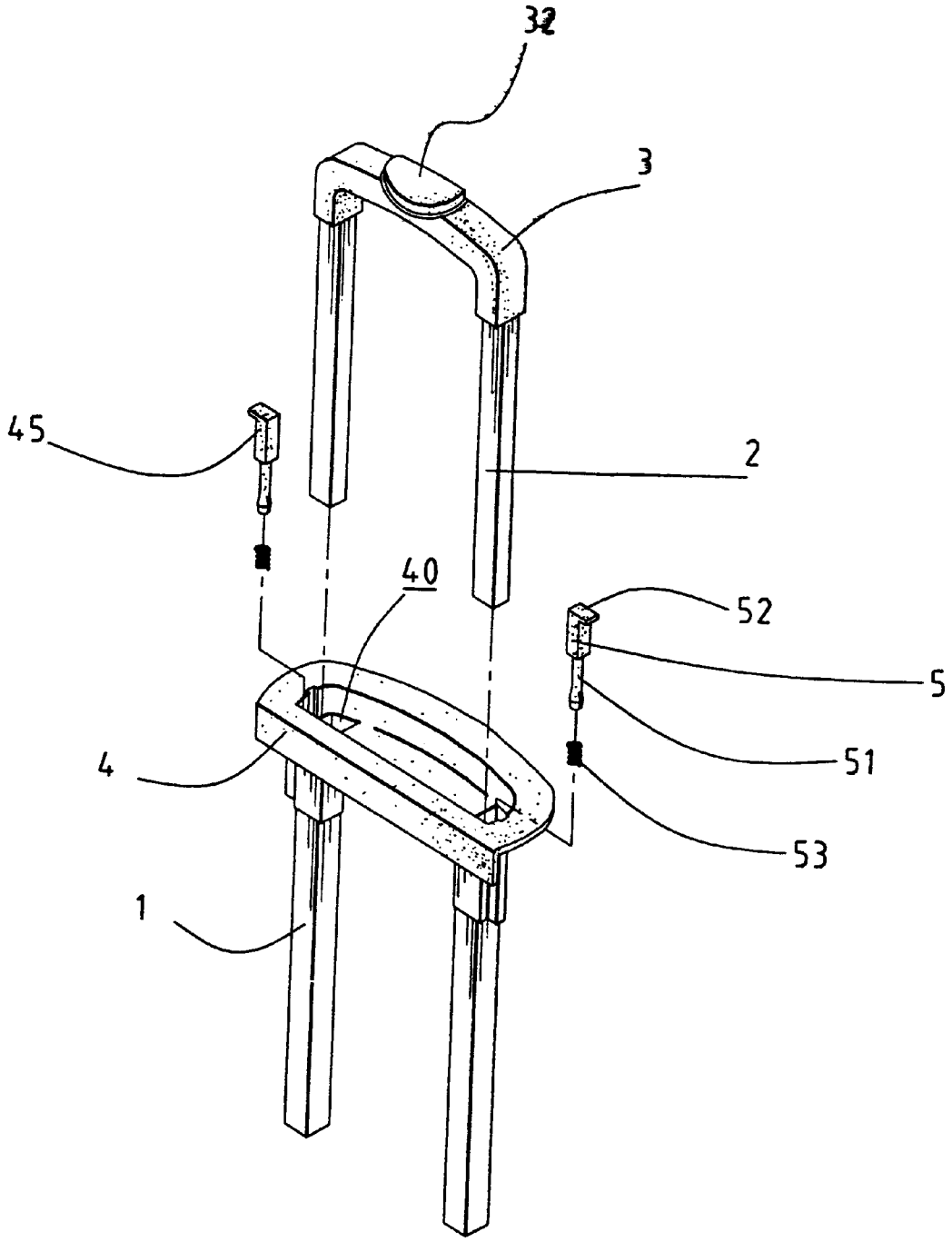
FIG. 2 is an exploded perspective view showing the assembly of the outer tubes, the inner tubes, the ejecting elements and the elastic elements of the present invention.
Figure 3:
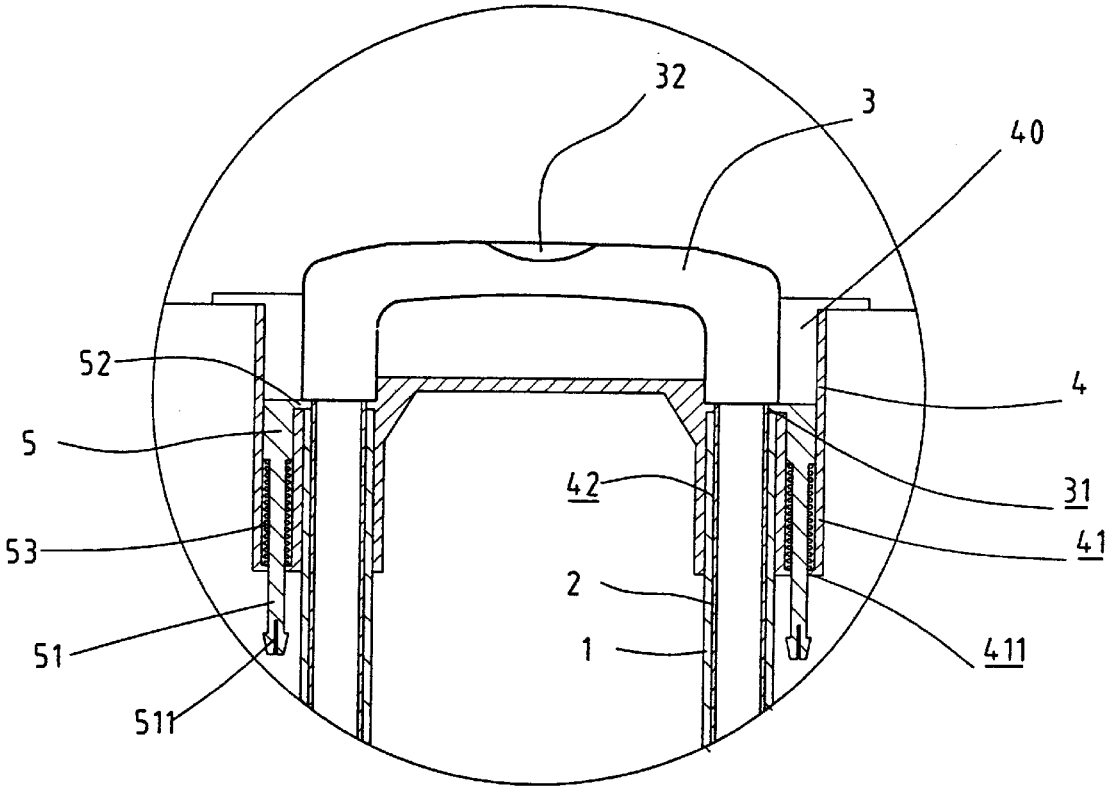
FIG. 3 is a plan cross sectional view showing a structure that the handle of the present invention is pressed to compress the elastic element.

With reference now to FIGS. 1 to 3, the hidden handle device of a trunk of the present invention is a handle device combined with a trunk and having the function of telescopic movement. The handle device includes two outer tubes 1 fixed on the trunk. A plurality of holes 11 are installed on the proper positions of the side walls of the outer tubes 1. A fixing seat 4 is installed on the upper end of the two outer tubes 1. A concave portion 40 is formed above the fixing seat 4. Each of the opposite two sides of the concave portion 40 is installed with a respective through hole 42. Each side of the through hole 42 is installed with a respective containing chamber 41 the lower surface of which is formed with a penetrating hole 411. The upper ends of the outer tubes 1 are penetrated through the through holes 42 of the fixing seat 4, then they are fixed by rivets so that the through holes 42 communicates with the inner spaces of the outer tubes 1. An elastic element 53 and an ejecting element 5 are sequentially arranged within the containing chamber 41. An axial rod 51 which can penetrate through the penetrating hole 411 is formed on the lower end of the ejecting element 5. A trench 511 is installed on the axial rod 51 so that the axial rod 41 has a radial elasticity. Furthermore, the lower end of the axial rod has formed with a tapered shape and has an inverse hook. The axial rod 51 is firstly penetrated through the elastic element 53 and then further through the through hole 411, next the inverse hook serves to hook the axial rod 51 on the penetrating hole 411 to prevent that the axial rod returns to the axial direction. Thus, the elastic element 53 is located between the lower portion of the ejecting element 5 and the containing chamber 41. The ejecting element 5 has an ejecting force by the elastic force of the elastic element 53 to apply on the ejecting element 5. Moreover, the two inner tubes 2 pass through the through holes 42 of the fixing seat 4 and the inner spaces of the outer tubes 1 so as to penetrate through the outer tubes 1. Holes are formed on the wall near the lower ends of the inner tubes 2 and pillars 21 with elasticity and can match with a spring are installed therewithin. A handle 3 is firmly installed on the common upper ends of the two inner tubes 2. Inner rims 31 are formed between the handle 3 and the inner tubes 2 so that when the inner tubes 2 has been completely penetrated through the outer tubes 1, the inner rim thereof will contact with the upper ends 52 of the ejecting elements 5. A button 32 is installed on the upper end of the handle 3. A driving means (not shown) is installed between the button 32 and the pillar 21. By pushing the button, the pillar 21 can contract into the inner tubes 2 through the driving of the driving means. Since the mechanics that the button 32 controls the pillar 21 are not within the scope of the present invention, thus it will not been described herein.

Figure 4:
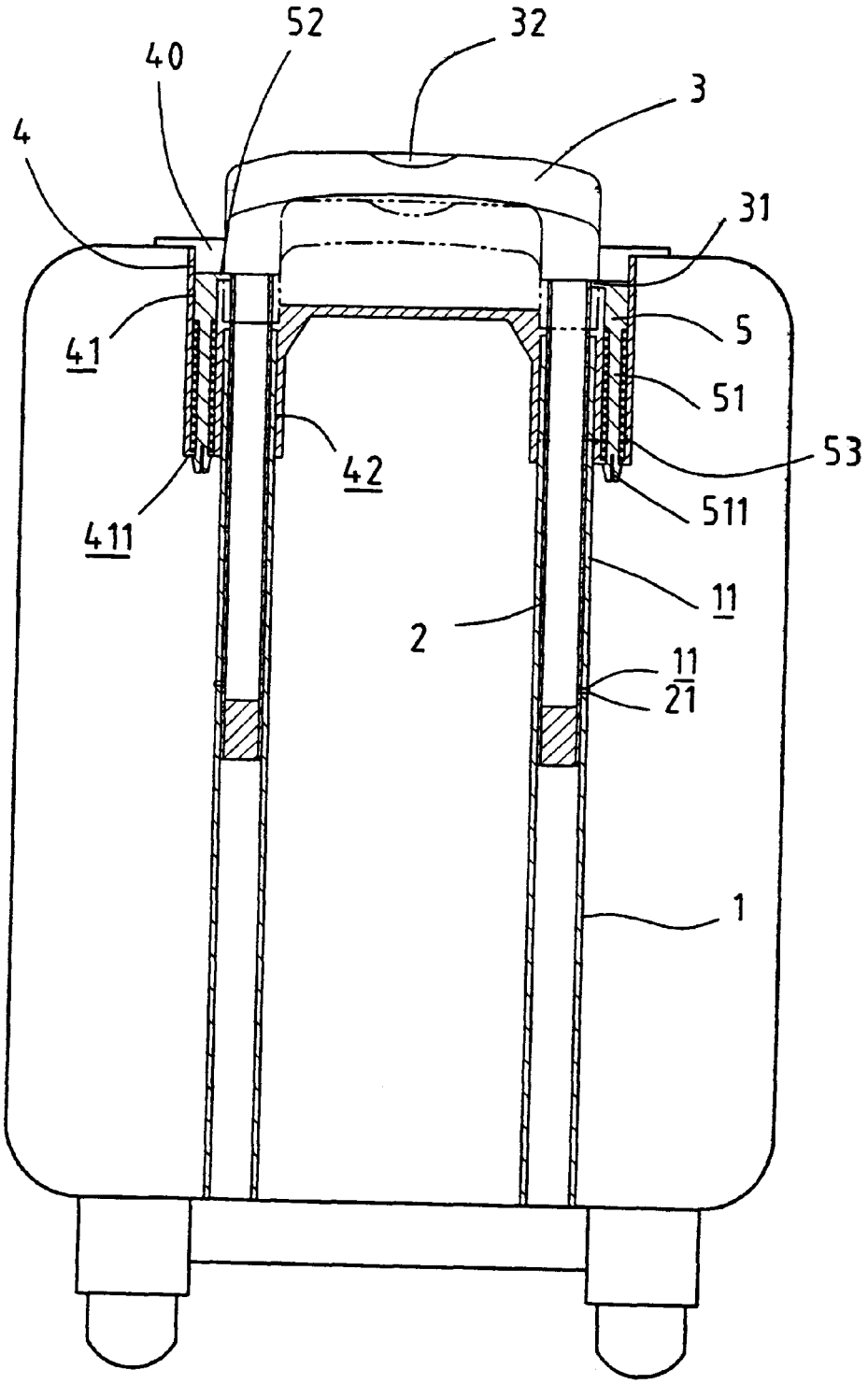
FIG. 4 is a partial plan cross sectional view of an embodiment showing that the handle of the present invention is ejected by the elastic element.

By the aforementioned structure, when the handle 3 is pushed downwards so that the inner tubes 2 can inserted into the outer tubes 2, the handle 3 is received into the concave portion 40 of the fixing seat 4, and the pillars 21 are buckled within the holes 11 of the outer tubes 1, the ejecting elements 5 will press downwards due to the force applied by the inner rim of the handle 3, so that the axial rod 51 can project from the penetrating hole 411 of the containing chamber 41. Further, this causes that the ejecting elements 5 to compress the elastic element 53 (as shown in FIG. 3). While as the button 32 is pressed to control the pillar 21 to release from the hole 411, the elastic element 53 will apple an elastic force on the ejecting element 5 so that the handle 3 will resile upwards to project from the containing chamber 40 of the fixing seat 4 (as shown in FIG. 4). Thus, this is preferred for pulling the inner tubes 2. Furthermore, by the design of the present invention, since the elastic element 53 is installed on the fixing seat 4 above the outer tubes 1 and is directly applied an elastic force on the inner rim 31 below the handle 3, therefore, the inner tubes 2 can be made shorter so that as it is wholly pulled out from the outer tube 1, the length outside the outer tube is not too long so to induce some inconvenience in operation.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A hidden handle device of a trunk comprising:

two outer tube having a plurality of holes on the side walls thereof;

two inner tubes each having a pillar for telescopically moving with the respective inner tube, and the inner tubes being inserted into the outer tube;

a fixing seat on the upper ends of the two outer tubes, a concave portion being formed thereabove, each of opposite two sides of the concave portion being installed with a through hole for being passed through by the inner tube; two containing chambers being formed on the respective side of the through holes;

two ejecting elements installed within the two containing chambers of the fixing seat, respectively;

two elastic elements installed on the respective containing chamber of the fixing seat and arranged between the lower portions of the ejecting elements and the lower surfaces of the containing chambers so that the ejecting elements have a upward elastic force;

a handle installed on the upper ends of the two inner tubes so that inner rims are formed between the handle and the inner tubes, the inner rims being contact with the ejecting elements respectively, the handle being installed with a button, a driving means being installed between the pillars and the button, by pushing the button, the pillars being controlled to present a telescopic movement on the side wall of the inner tubes;

characterized in that: when the handle is pushed downwards so that the handle is received with the concave portion of the fixing seat, and the aforementioned pillars are buckled in the holes of the outer tubes, the ejecting elements, compressed by the inner rims, will press the elastic elements, while when the button is pushed so that the pillar is released from the hole, then by the elastic elements applying an elastic force on the ejecting elements, the handle will resile upwards, therefore, the inner tube will be easily pulled out.

2. The hidden handle device of a trunk as claimed in claim 1, wherein a penetrating hole is formed on the lower surface within each containing chamber of the fixing seat, and an axial rod for penetrating through the penetrating hole is formed on the lower end of each ejecting element, thereby, the axial rod can penetrate through the elastic element and then further pass through the penetrating hole of the containing chamber.

* * * * *